US008474080B2

(12) United States Patent
Kim et al.

(10) Patent No.: US 8,474,080 B2
(45) Date of Patent: Jul. 2, 2013

(54) CONSTRUCTION METHOD OF STEEL COMPOSITION GIRDER BRIDGE

(75) Inventors: Yong Joo Kim, Gwangju (KR); Jae Min Kim, Seoul (KR)

(73) Assignees: Hyung Kyun Byun, Seoul (KR); Mi Young Lim, Suncheon-si (KR); Yong Joo Kim, Gwangju-si (KR)

( * ) Notice: Subject to any disclaimer, the term of this patent is extended or adjusted under 35 U.S.C. 154(b) by 0 days.

(21) Appl. No.: 13/059,933

(22) PCT Filed: Jun. 4, 2010

(86) PCT No.: PCT/KR2010/003590

§ 371 (c)(1),
(2), (4) Date: Feb. 18, 2011

(87) PCT Pub. No.: WO2011/093556

PCT Pub. Date: Aug. 4, 2011

(65) Prior Publication Data

US 2012/0279000 A1 Nov. 8, 2012

(30) Foreign Application Priority Data

Jan. 29, 2010 (KR) ..... 10-2010-0008408

(51) Int. Cl.
*E01D 21/00* (2006.01)
*E01D 21/06* (2006.01)

(52) U.S. Cl.
CPC ..... *E01D 21/06* (2013.01)
USPC ..... 14/77.1; 52/745.19

(58) Field of Classification Search
CPC ..... E01D 21/06
USPC ..... 14/73–77.1; 52/745.19–746.1
See application file for complete search history.

(56) References Cited

U.S. PATENT DOCUMENTS

| | | | | |
|---|---|---|---|---|
| 4,991,248 | A * | 2/1991 | Allen | 14/73 |
| 5,437,082 | A * | 8/1995 | Maenaka | 28/190 |
| 5,978,997 | A | 11/1999 | Grossman | |
| 7,461,427 | B2 * | 12/2008 | Ronald et al. | 14/77.1 |
| 8,060,966 | B2 * | 11/2011 | Homsi | 14/77.1 |
| 8,266,751 | B2 * | 9/2012 | He | 14/77.1 |

FOREIGN PATENT DOCUMENTS

| | | | |
|---|---|---|---|
| JP | 06228913 | * | 3/1993 |
| JP | 09-256320 | A | 9/1997 |
| KR | 10-2002-0088472 | A | 11/2002 |
| KR | 10-2006-0041078 | A | 5/2006 |
| WO | 2011/093556 | A1 | 8/2011 |

* cited by examiner

*Primary Examiner* — Raymond W Addie

(57) ABSTRACT

A construction method of a steel composite girder bridge includes installing steel girders on piers and forming shearing connectors on the steel girders at intervals of a predetermined distance, installing stagings and a first form for casting deck concrete in the steel girders, installing non-composite members in an upper flange of the steel girders to form each non-composite section of supporting points, installing a second form around each of the shearing connectors to form a shearing pocket, arranging sheath pipes in the supporting points and forming supporting point decks by casting and curing concrete, applying pre-stress to each section of the supporting point decks through the sheath pipes and performing a grouting process, forming span decks adjacent to the supporting point decks by casting and curing concrete in each span between the piers, and filling the shearing pockets with non-shrinkage mortar.

4 Claims, 10 Drawing Sheets

CONSTRUCTION METHOD OF STEEL COMPOSITION GIRDER BRIDGE

PRIORITY

The present application claims priority under 35 U.S.C. §371 to PCT Application PCT/KR2010/003590, filed on Jun. 4, 2010, which claims priority to Korean Patent Application No. 10-2010-0008408, filed on Jan. 29, 2010, the disclosures of which are hereby incorporated by reference in their entireties.

BACKGROUND OF THE INVENTION

1. Field of the Invention

The present invention relates to a construction method of a steel composite girder bridge, and more particularly, to a construction method of a steel composite girder bridge, in which a cast-in-place deck has non-composite cross sections when applying pre-stress, and after the pre-stress has been applied, the non-composite cross sections act as composite sections by filling each position of shearing connectors with non-shrinkage mortar.

2. Description of the Related Arts

Generally, a bridge is a kind of overhead structure for crossing rivers, lakes and marshes, straits, bays, canals, lowlands, traffic routes or any other structures. As shown FIG. 1, the bridge is divided into an upper structure 10 and a lower structure 20.

The upper structure 10 is placed on abutments 22 or piers 24 and generally comprises girders 12 or slabs 14.

The type of the bridge is determined by the shape of a main member, generally, which receives the most power. In case that the main member is a girder 12, the bridge is referred to as a girder bridge. The slabs 14 are decks on which vehicles can run and in which concrete is cast. The lower structure 20 comprises the abutments 22 or the piers 24 which transfer a load applied from the upper structure 10 to the ground safely.

The abutments 22 are end supporting points of the bridge and the piers 24 are intermediate supporting points except for the end supporting points. According to the state of the ground under the piers 24, the type of foundation such as a direct foundation, a pile foundation, a caisson foundation is determined, and a base slab 26 is placed in each lower part of the piers 24.

On the other hand, there are some methods of casting concrete into the slabs 14 which are decks. One method is a cast-in-place method in which concrete is cast in a construction site, and another method is a pre-cast method in which concrete previously made in a factory is used.

Because the cast-in-place is performed in a construction site, tensile stress is occurred in each negative moment section of supporting points on the upper part of the bridge, so that the cross section of the decks is not valid. If the pre-stress is applied to the decks, even though the tensile stress for the negative moment is occurred, the cross section of the decks is valid in compressive stress state by the pre-stress.

In the conventional methods, when applying the pre-stress, a pre-cast deck is used, but economical efficiency is lowered. Alternatively, in case of applying the pre-stress to a cast-in-place deck, the pre-stress is applied in the state in which the deck is composed with the girder. Thus, there is a problem that the state of stress can be bad by compressive stress occurred in the girder.

SUMMARY OF THE INVENTION

The present invention has been developed to solve the above-described problems.

According to the present invention there is provided a construction method of a steel composite girder bridge. The method comprises the steps of: installing steel girders on piers, on which shearing connectors are continuously formed at intervals of a predetermined distance; installing stagings and a first form for casting deck concrete in the steel girders; installing non-composite members in each upper flange of the steel girders which form each non-composite section of the supporting points and installing a second form around the shearing connectors; arranging sheath pipes in the each supporting point, forming supporting point decks by casting and curing concrete, and forming shearing pockets in each position of the shearing connectors by using the second form; applying pre-stress to each section of the supporting point decks through the sheath pipes and performing a grouting process; forming span decks by casting and curing concrete in each span between the piers and filling the shearing pockets with non-shrinkage mortar; and forming a road after dismantling the stagings and the first and the second forms, and forming protection walls.

The non-composite members may be one of adhesive sheet, vinyl, tape, fiber and grease.

The pre-stress is applied when the concrete compressive strength of each section of the supporting point decks is equal or more than 28 Mpa.

The type of the steel composite bridge is an open-top girder, a rectangular girder, a plate girder or a minor plate girder.

In the construction method of a steel composite girder bridge according to the present invention, the compressive stress is not occurring in the steel girder, thereby preventing the steel girder from being under bad stress. Further, the cost can be reduced by using cast-in-place decks when applying the pre-stress, thereby improving economical efficiency.

DETAILED DESCRIPTION OF THE EMBODIMENTS

Figure 1:
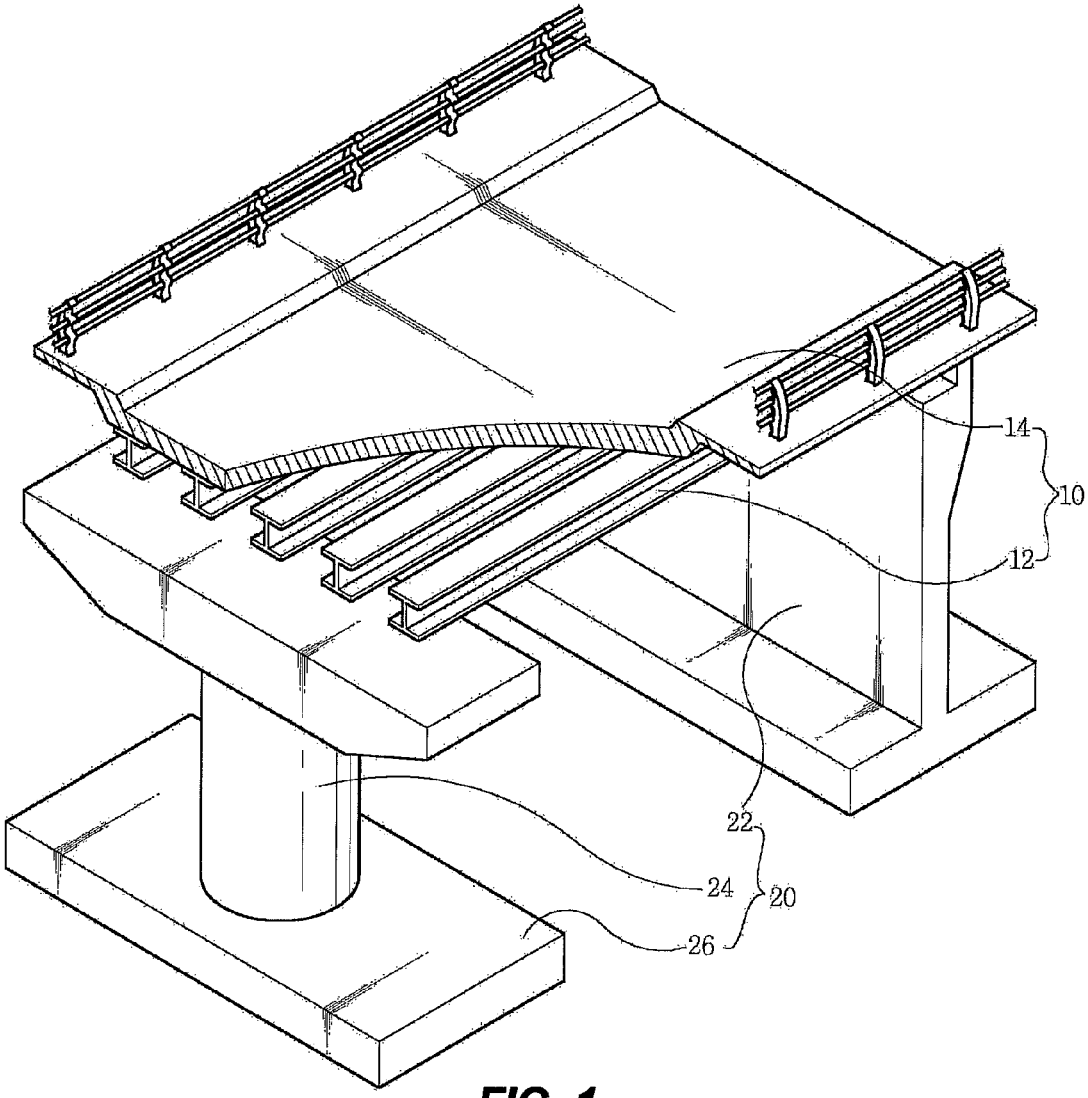
FIG. 1 shows a structural view of a general girder bridge.

Referring now to the accompanying drawings, a construction method of a steel composite girder bridge according to an embodiment of the present invention will be described herein in detail. It is noted that like parts are designated by like reference numerals throughout the accompanying drawings.

Figure 2:
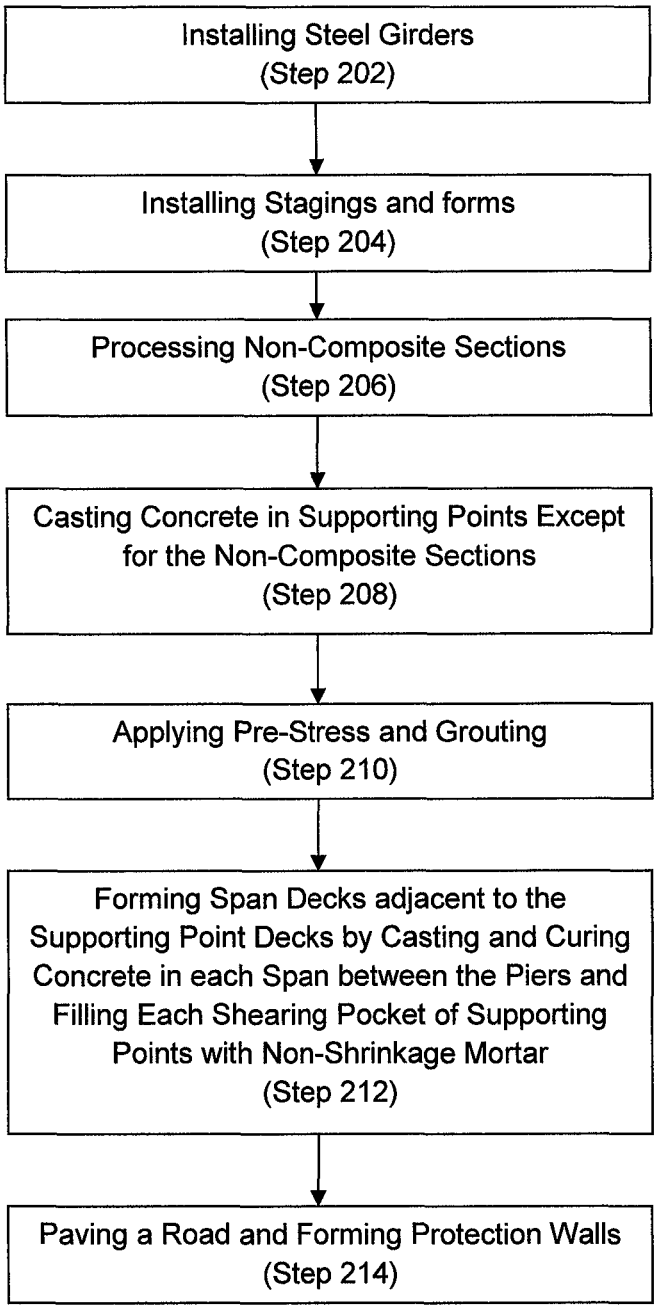
FIG. 2 shows a flow chat of a construction method of a girder bridge according to an embodiment of the present invention.

FIG. 2 shows a flow chart of a method for constructing a girder bridge according to an embodiment of the present invention and FIGS. 3 to 9 show details of processes of the method. Particularly, FIGS. 3*b* and 9*b* are a cross-sectional view showing the place where strut beams 50 of L-shape steel for reinforcing steel girders 31 are installed at predetermined intervals.

Figure 3A:
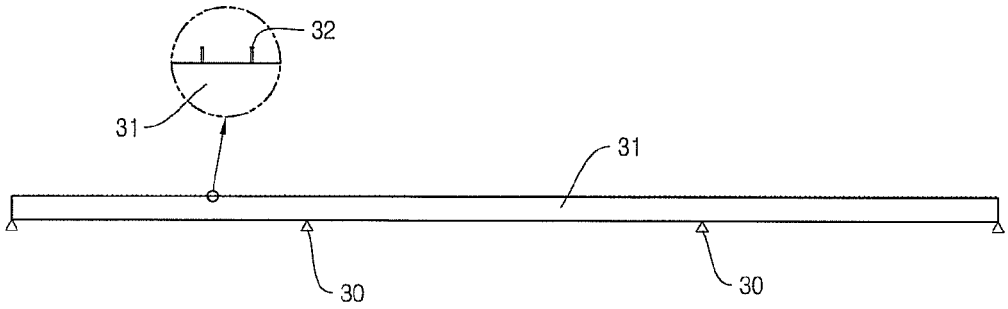
FIGS. 3 to 9 show details of processes of the method.
Figure 3B:
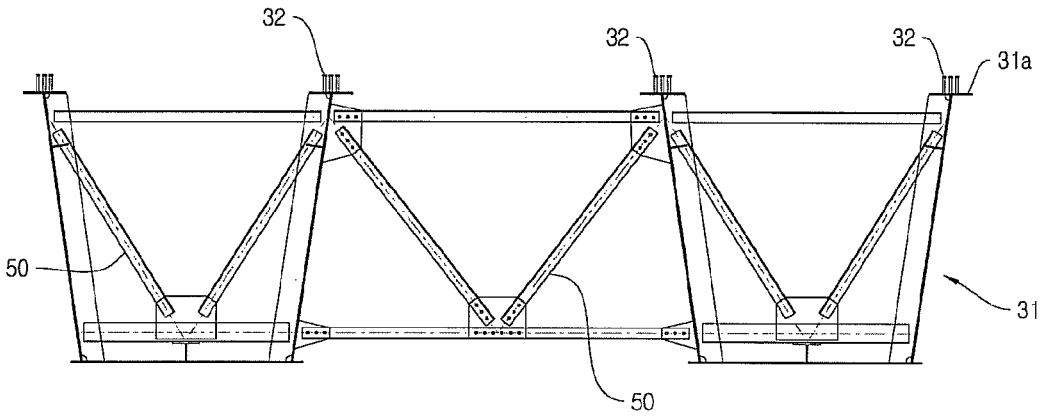

As shown a side view and a cross-sectional view of FIGS. 3*a* and 3*b*, the steel girders 31 are installed in piers 30 by using a crane, etc., and shearing connectors 32 are continuously formed in the upper side of each the steel girder 31 at intervals of a predetermined distance (step 202).

Figure 4A:
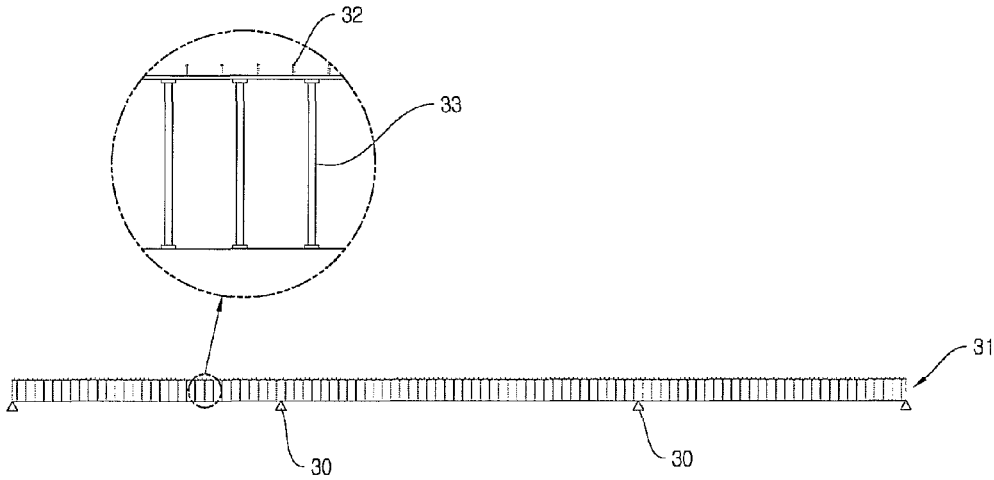
Figure 4B:
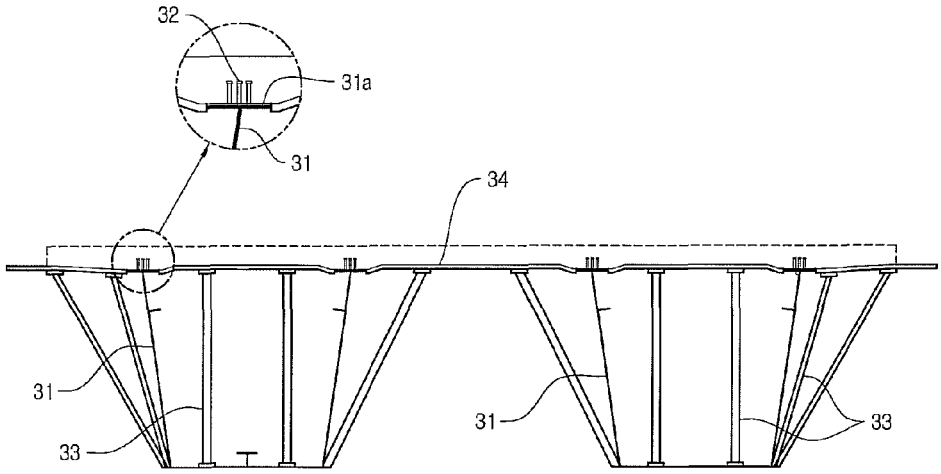

Next, as shown a side view and a cross-sectional view of FIGS. 4*a* and 4*b*, the first form 34 for casting deck concrete is installed on a floor, and stagings 33 for supporting the first form 34 are installed in each the steel girder 31. However, the first form 34 is not installed in an upper plate 31*a* of each the steel girder 31 in which the shearing connectors 32 are installed (step 204).

Then, the part of each the steel girder 31 in which the first form 34 is not installed become non-composite sections a in which compressive stress is not occurred in the steel girders 31 when applying pre-stress.

Figure 5A:
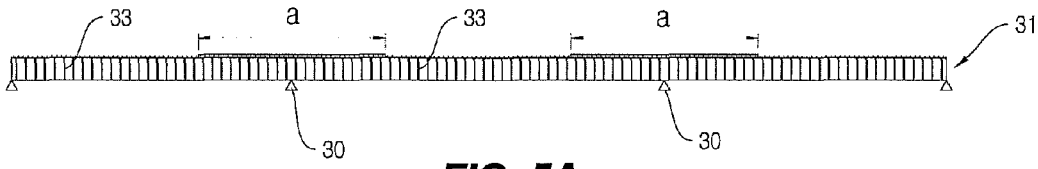
Figure 5B:
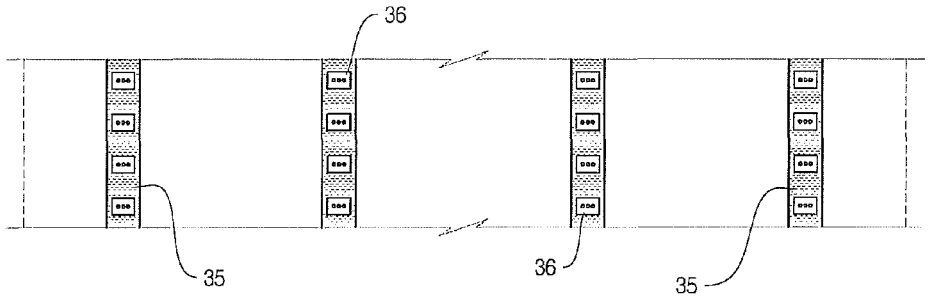
Figure 5C:
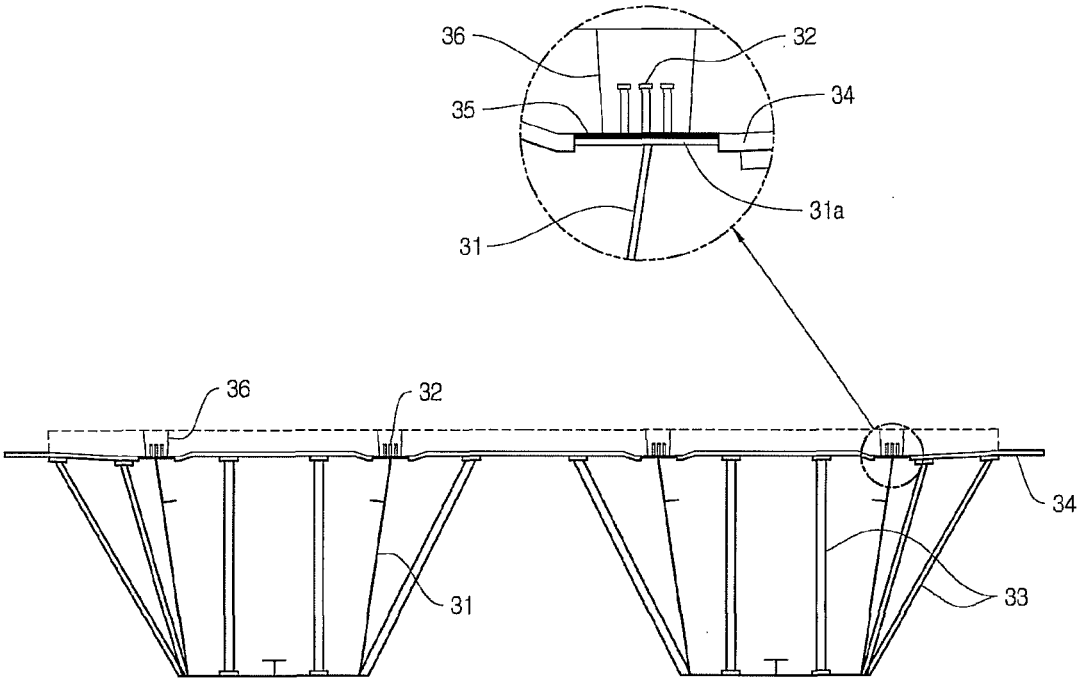

Next, as shown a side view, a plane view and a cross-sectional view of FIGS. 5*a* to 5*c*, non-composite members 35 are installed in an upper flange 31*a* of each the steel girder 31 which forms non-composite sections a of supporting points, and in order not to allow concrete to be cast when casting deck concrete, the second form 36 is installed in all sides of each the upper flange 31*a* around the shearing connectors 32.

Then, the non-composite members 35 may be any materials capable of ensuring a non-composite property, such as adhesive sheet, vinyl, tape, fiber, grease and the like. In the non-composite sections a, a non-composite action between the upper flange 3*a* of each the steel girder 31 and each supporting point deck 39 is induced when applying the pre-stress to the supporting point decks 39.

Figure 6A:
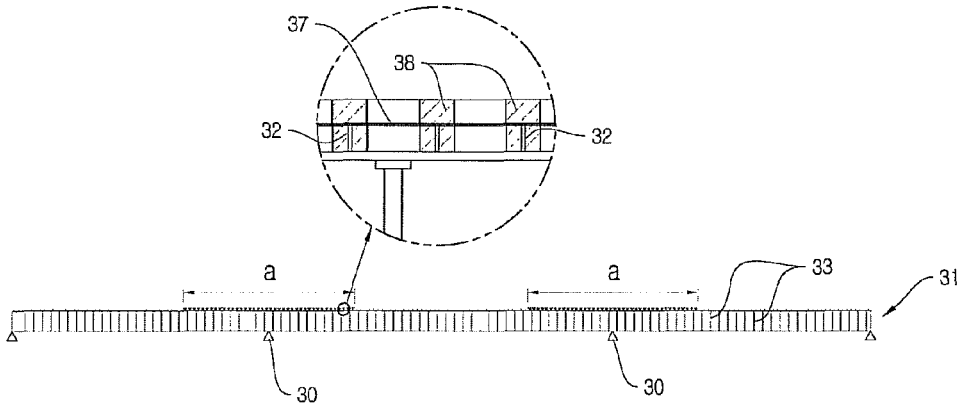
Figure 6B:
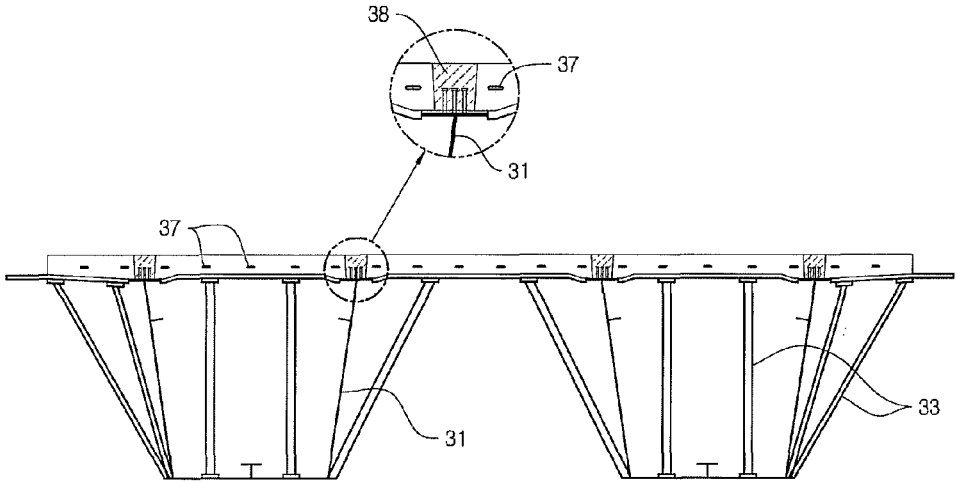

Next, as shown a side view and a cross-sectional view of FIGS. 6*a* and 6*b*, concrete is cast and cured after arranging sheath pipes 37 and steel wires for applying the pre-stress, thereby forming the supporting point decks 39 (step 208).

Then, the second form 36 excludes concrete from the circumference of each the shearing connector 32 so that shearing pockets 38 are formed.

The sheath pipes 37 are arranged previously before casting concrete in order to make an placement hole of pre-stress steel material (not shown) in a post tension manner.

Figure 7A:
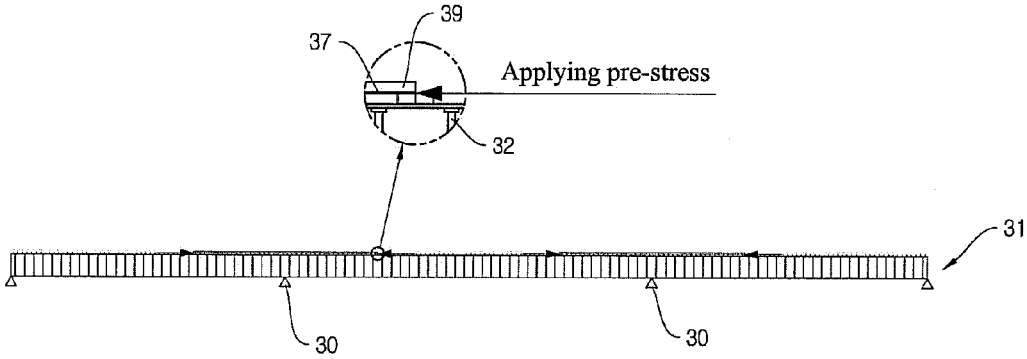
Figure 7B:
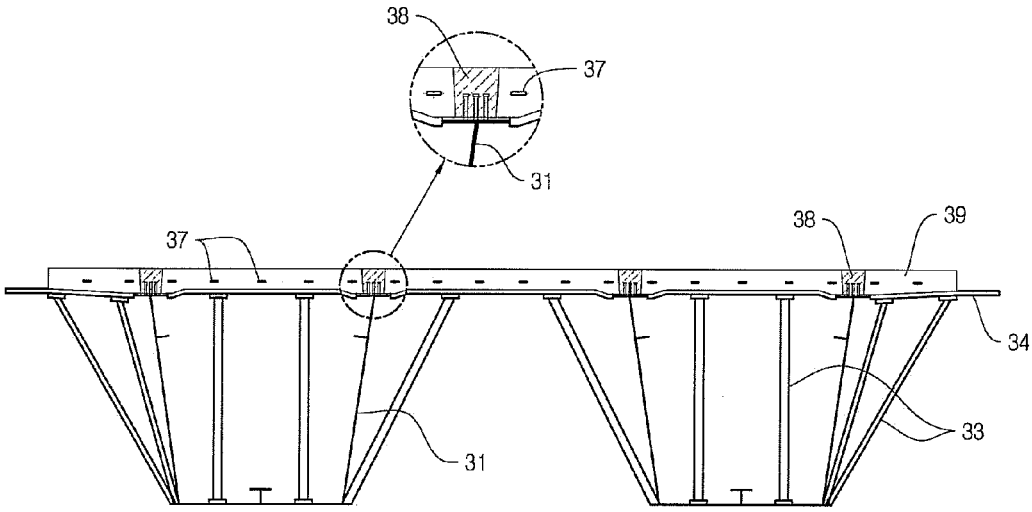

Next, as shown a side view and a cross-sectional view of FIGS. 7*a* and 7*b*, when concrete has been cured and the concrete compressive strength of each section of the supporting point decks 39 is equal or more than the standard design value of highway bridge, for example 28 Mpa ($N/mm^2$), the pre-stress steel materiel is inserted into each the sheath pipe 37 and the pre-stress is applied to the supporting point decks 39 by compressive stress.

Further, a grouting process for pressing and injecting cement, paste or mortar by using a pump is performed between each the sheath pipe 37 and the pre-stress steel material (step 210).

As described above, in the present invention, the supporting point decks 39 are not composed with the steel girders 31 when applying the pre-stress to the supporting point decks 39. Therefore, when the pre-stress is applied, compressive stress is not occurred in the steel girders 31.

Figure 8A:
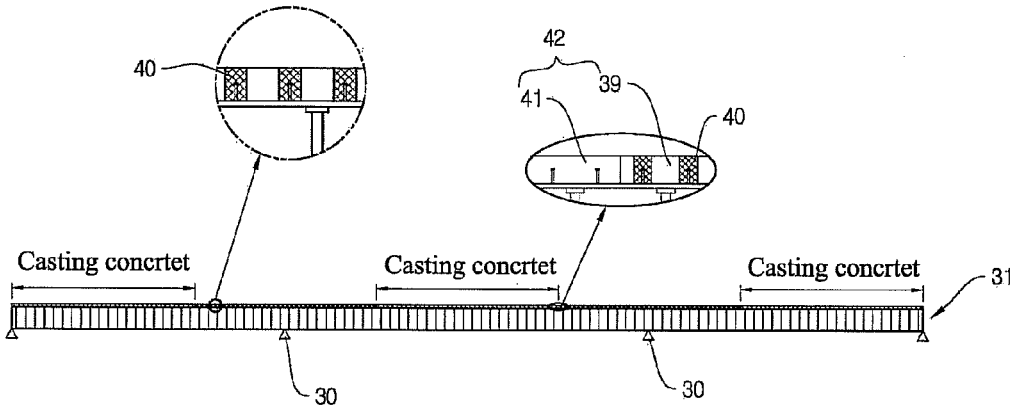
Figure 8B:
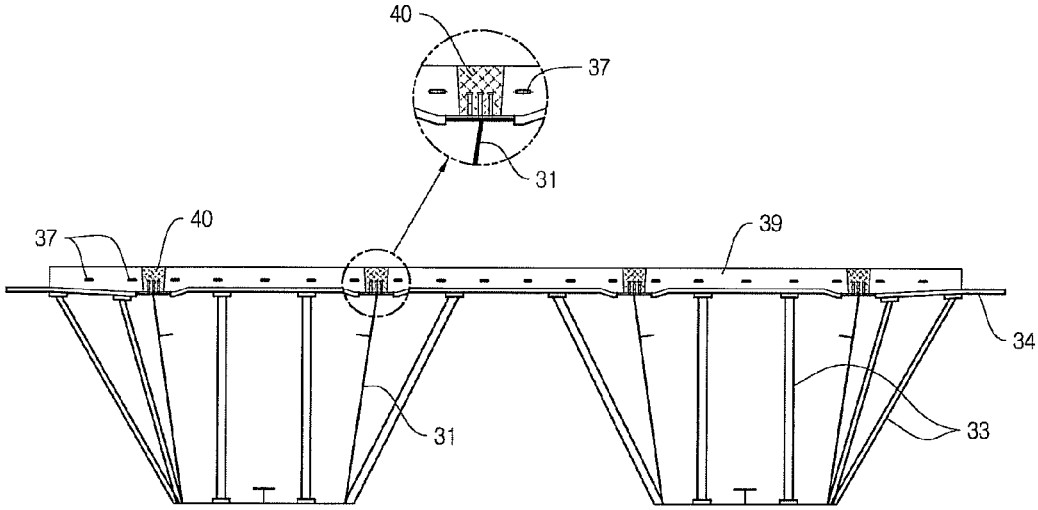

Next, as shown a side view and a cross-sectional view of FIGS. 8*a* and 8*b*, concrete is cast and cured in each span between the piers to form span decks 41.

Further, each the shearing pocket 38 of the supporting points is filled with non-shrinkage mortar 40, so that a composite action between the steel girders 31 and the supporting point decks 39 is induced (step 212).

The whole deck 42 of the girder bridge comprises the supporting point decks 39 and the span decks 41.

Figure 9A:
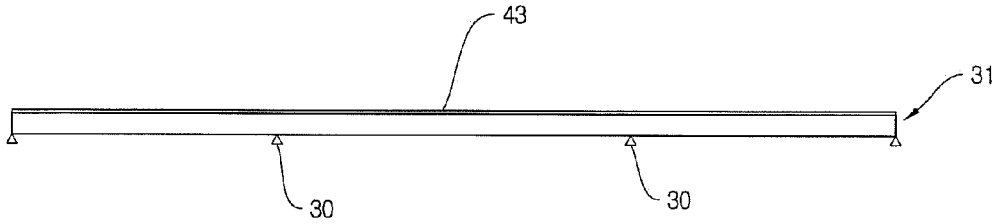
Figure 9B:
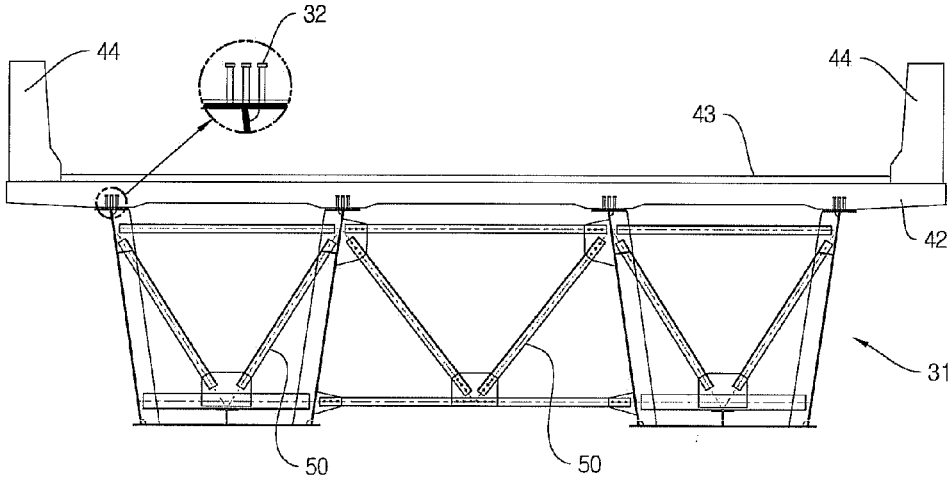

And, as shown a side view and a cross-sectional view of FIGS. 9*a* and 9*b*, after dismantling the stagings 33 and the forms 34 and 36, the deck 42 is paved with appropriate paving material for a bridge deck to form a road 43, and protection walls 44 are installed along both sides of the road 43, so that the construction of the girder bridge is completed (step 214).

The type of the steel composite bridge to which the construction method according to the present invention can be applied is an open-top girder, a rectangular girder, a plate girder or a minor plate girder.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A construction method of a steel composite girder bridge, the method comprising:

installing steel girders on piers and forming shearing connectors continuously on the steel girders at intervals of a predetermined distance;

installing stagings and a first form for casting deck concrete in the steel girders;

installing non-composite members in an upper flange of the steel girders to form each non-composite section of supporting points and installing a second form around each of the shearing connectors, wherein the second form forms a shearing pocket;

arranging sheath pipes in the supporting points and forming supporting point decks by casting and curing concrete;

applying pre-stress to each section of the supporting point decks through the sheath pipes and performing a grouting process;

forming span decks adjacent to the supporting point decks by casting and curing concrete in each span between the piers;

filling the shearing pockets with non-shrinkage mortar; and forming a road after dismantling the stagings and the first and second forms, and forming protection walls.

2. The construction method according to claim 1, wherein the non-composite members include adhesive sheet, vinyl, tape, fiber and grease.

3. The construction method according to claim 1, wherein the pre-stress is applied when the concrete compressive strength of each section of the supporting point decks is equal to or greater than 28 Mpa.

4. The construction method according to claim 1, wherein the steel composite girder bridge is an open-top girder type, a rectangular girder type, a plate girder type or a minor plate girder type.

* * * * *